United States Patent [19]

Carter

[11] 4,405,282

[45] Sep. 20, 1983

[54] LOAD BEARING ARRANGEMENT FOR A MOVABLE BUCKET FORK LIFT ATTACHMENT

[76] Inventor: Jack D. Carter, 609 Curdes Ave., Fort Wayne, Ind. 46805

[21] Appl. No.: 297,038

[22] Filed: Aug. 27, 1981

[51] Int. Cl.[3] ..... B66F 9/00

[52] U.S. Cl. ..... 414/724; 414/607; 414/912

[58] Field of Search ..... 37/117.5, DIG. 3, DIG. 12; 414/724, 607, 686, 723, 697, 629, 631, 639, 641, 642, 785, 912; 187/9 R; 172/272

[56] References Cited

U.S. PATENT DOCUMENTS

| | | | |
|---|---|---|---|
| 2,281,928 | 5/1942 | Fletcher | 262/8 |
| 2,447,150 | 8/1948 | Andersen | 414/724 |
| 2,473,505 | 6/1949 | Brock | 37/117.5 |
| 3,312,361 | 4/1967 | Foster | 414/724 |
| 3,421,642 | 1/1969 | Carter | 414/724 |
| 3,795,331 | 3/1974 | Guest | 414/724 |
| 4,125,952 | 11/1978 | Jennings | 37/117.5 |
| 4,247,243 | 1/1981 | Carter | 414/724 |

FOREIGN PATENT DOCUMENTS

| | | | |
|---|---|---|---|
| 1373646 | 11/1974 | United Kingdom | 414/724 |

*Primary Examiner*—Robert J. Spar
*Assistant Examiner*—Terrance L. Siemens
*Attorney, Agent, or Firm*—Albert L. Jeffers

[57] ABSTRACT

A conventional earth moving bucket is provided with hooks and an elongated support member extending across the top edge of the bucket on which a load bearing surface of an attachment may rest so that the weight of the attachment and any associated load carried by the attachment is borne primarily by the elongated member while the hooks function to align the attachment with the elongated member and to prevent accidental release of the attachment. In a preferred form, the load bearing surfaces of the attachment comprise relatively short horizontally extending portions of fork lift elements near the upper extremities of those fork lift elements.

9 Claims, 6 Drawing Figures

LOAD BEARING ARRANGEMENT FOR A MOVABLE BUCKET FORK LIFT ATTACHMENT

BACKGROUND OF THE INVENTION

The present invention relates generally to attachments for power earth moving machines and more particularly to load bearing arrangements for supporting such attachments.

Typical power earth moving machines employ a movable arm of one or more links or members pivotably interconnected and having hydraulic or other actuating devices for operating a tool such as an earth moving bucket or blade supported on that arm. Numerous attachments for the earth moving machine tool have been devised including the fork lift attachment disclosed in my prior U.S. Pat. No. 3,421,642.

In my prior patented arrangement, a fork lift attachment can be easily mounted on and removed from a conventional loader bucket by rotating that bucket in one sense and hookingly engaging the attachment whereupon the bucket is rotated in the opposite sense until the fork lift attachment engages the bucket lower edge thereby locking the attachment to the bucket for subsequent use. This arrangement has met with considerable commercial success due at least in part to the ease with which the attachment may be picked up, used and later removed, freeing the machine for other work. The locking of the attachment to the bucket is not, however, a complete locking but rather the attachment and bucket are coupled firmly only in normal bucket and attachment operating attitudes. Gravitational or inertial forces on the attachment as might be experienced by wildly swinging the arm of the earth moving machine or as might occur when the earth moving machine tool is moved to a position or orientation not suited to normal fork lift operation could allow the attachment to become disengaged from the bucket causing equipment damage or injury to an operator or bystander.

The safety aspects of such a fork lift attachment have been materially improved, for example, as illustrated in my prior U.S. Pat. No. 4,247,243, the features of which may be used in conjunction with the present invention. In this later United States Patent, it will be noted that four hooks are illustrated affixed to the upper edge of the movable bucket, whereas in my earlier U.S. Patent, only three such hooks are illustrated. This additional hook has been used since it was found that the horizontal support bar which interconnects the upper ends of the L-shaped fork lift elements which bears the weight of those elements and associated loads may frequently become bent due to overloading of the fork lift elements. The addition of a fourth hook to the upper edge of the bucket has only partially cured the problem of bending the horizontal support or bar due to overloading.

SUMMARY OF THE INVENTION

Among the several objects of the present invention may be noted the provision of an earth moving machine attachment where the weight of that attachment and any associated load is borne by structure independent of the prior art arrangement for engaging and disengaging such attachments; the provision of an arrangement for supporting the weight of fork lift elements and any associated load independent of the retaining hooks and elongated horizontal bar associated with such fork lift elements; the provision of an improved fork lift attachment for a movable bucket; and the provision of a virtually indestructible fork lift attachment for a movable bucket.

These as well as other objects and advantageous features of the present invention will be in part apparent and in part pointed out hereinafter.

In general and in one form of the invention, an attachment for a movable bucket having a plurality of spaced notched retaining hooks and support means fastened to the upper portion of the movable bucket intermediate the retaining hooks includes an elongated horizontal bar to be picked up by the retaining hooks and having first and second fork lift elements mounted thereon, each of a generally L-shaped configuration, and each including a load bearing surface adjacent the horizontal bar for engaging the bucket support means so that the weight of the fork lift elements and any load carried by those elements is in turn carried primarily by the support means on the upper portion of the bucket rather than by the elongated horizontal bar and spaced retaining hooks.

Figure 1:
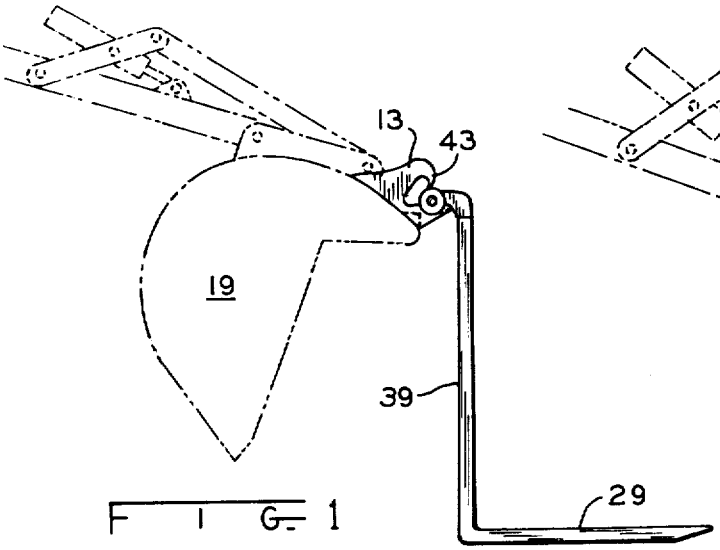
FIG. 1 is a side elevation view of a power earth moving machine arm and bucket in preliminary engagement with a fork lift attachment.

Corresponding reference characters indicate corresponding parts throughout the several views of the drawing. The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 2:
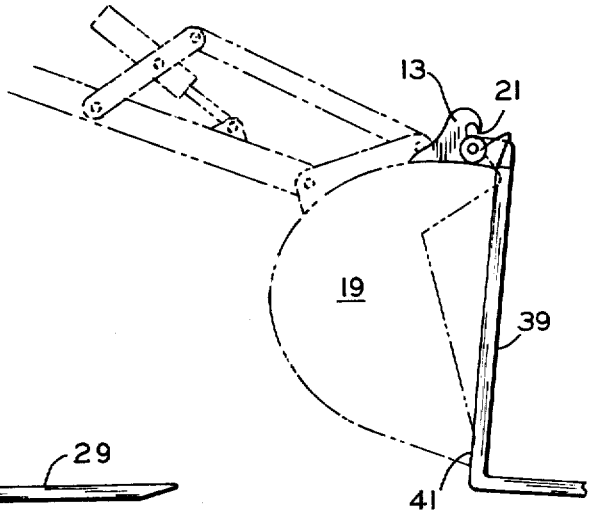
FIG. 2 is a side elevation view similar to FIG. 1 but illustrating the bucket with the fork lift attachment mounted thereon in normal operating attitude.
Figure 5:
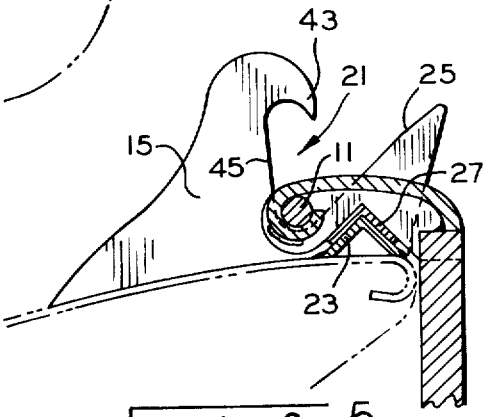
FIG. 5 is a view in section along line 5-5 of FIG. 4.
Figure 6:
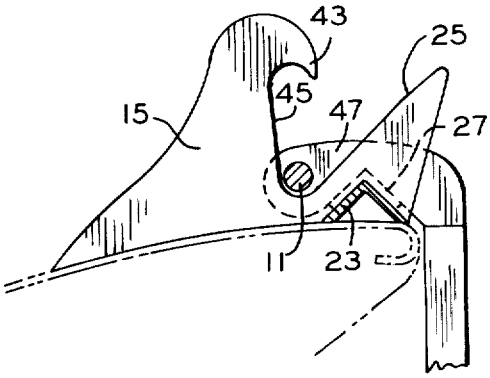
FIG. 6 is a view similar to FIG. 5 but along line 6-6 of FIG. 4.

In general, the attachment according to the present invention has an elongated horizontal support 11 which is adapted to sit over a plurality of spaced retaining hooks 13, 15 and 17 with those retaining hooks being fastened, for example by welding, to the upper portion of a movable bucket 19. Each retaining hook has a notch 21 for receiving the horizontal support bar 11. The upper edge bucket 19 is also provided with an elongated bar 23 also, for example, welded to the upper portion of the bucket. In conventional pushing, moving or hauling uses of the bucket, the hooks 13, 15 and 17 and the elongated bar 23 do not interfere with bucket operation, yet when it is desired to use the bucket for fork lift purposes, the fork lift attachment may be rather easily attached to the bucket by engaging the notches, such as 21, with the elongated horizontal bar 11 so that that bar 11 slides along the guide surface 25 of notch 21 until the bar 11 rests in the base of the notch, as illustrated for example in FIGS. 5 and 6, whereupon the bucket is rotated from the attitude illustrated in FIG. 1 to that illustrated in FIG. 2, so that the load bearing surface 27 of the L-shaped fork lift element comes to rest on the support 23 with the weight of those fork lift elements, as well as any load carried thereby, being borne by the support 23 rather than the hooks 13, 15 and 17. Of course, to disengage the attachment, the bucket 19 is rotated from the position illustrated in FIG. 2 to that illustrated in FIG. 1, and the lower horizontal portions 29 are merely rested on the ground and the bucket withdrawn, dispengaging to the notches, such as 21, from the elongated bar 11.

Figure 4:
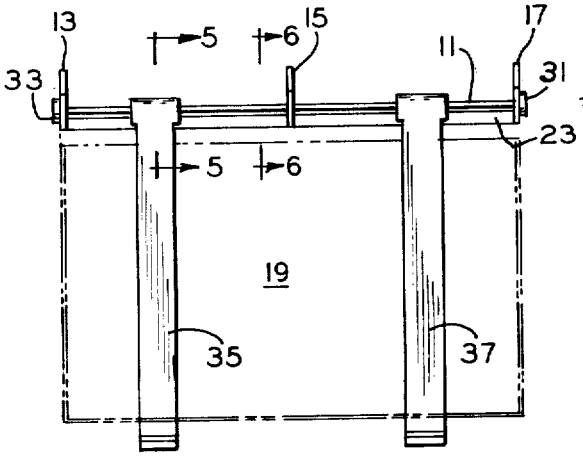
FIG. 4 is a front view of the bucket and attachment in the attitude illustrated in FIG. 2.

As in my prior patented arrangement, the movable bucket attachment of the present invention has a plurality of substantially similar spaced retaining hooks 13, 15 and 17, each having a notch, such as 21, with an opening intermediate the ends of that notch. The attachment includes the elongated horizontal support or bar 11, the length of which exceeds the distance between the outer ones 13 and 17 of the spaced retaining hooks, as seen in FIG. 4. Outboard of these hooks, the bar 11 may be provided with retainers 31 and 33 so that the bar does not slide laterally out of the hooks. The bar 11 may be easily picked up by the retaining hooks to slide along surface 25 of those hooks and into the position illustrated in FIG. 2. The attachment further includes a pair of fork lift elements 35 and 37 mounted on the bar 11 and each having a rigid generally L-shaped configuration including a vertical portion 39 and horizontal portion 29 with the upper end of the vertical portion 39 being mounted on the horizontal bar. In its operational position, the lower part of the vertical portion 39 rests against the forward face 41 of the bucket with the horizontal portion 29 extending forwardly from the bucket and the end of that horizontal portion spaced from the bucket.

Unlike my prior patented arrangements, support means, such as the elongated bar 23, is fastened as by welding to the upper portion of the movable bucket so as to lie intermediate the retaining hooks. The upper end of the vertical portion of the fork lift elements includes the load bearing surface 27 for engaging the support or bar 23 so that the weight of the fork lift elements 35 and 37, as well as any load resting on the horizontal portion 29, is borne primarily by the support 23.

Figure 3:
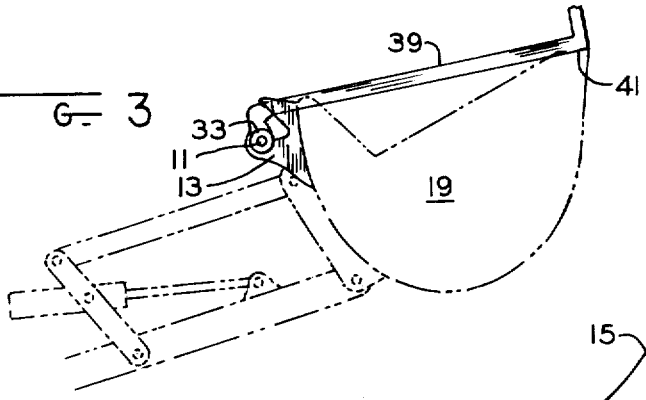
FIG. 3 is a side elevation view similar to FIGS. 1 and 2 but illustrating the bucket and attachment raised quite high and rotated out of the normal operating attitude where the attachment may slide relative to the bucket.

At least two hooks should be provided with the guiding surface 25 and similarly at least two hooks should include safety catches in the form of the overhanging lip 43. This overhanging lip normally overlies the horizontal bar 11 and functions to retain that bar within the hook notches in the event that the bucket is moved to a position such as illustrated in FIG. 3, where the fork lift elements may slide along the forward face of the bucket, thus moving the bar 11 from the position illustrated in FIGS. 5 and 6 into the upper region of the notch beneath lip 43. If the bucket as illustrated in FIG. 3 is further rotated in a counterclockwise direction, the fork lift elements 35 and 37 will eventually pivot under the influence of gravity away from the front edge 41 of the bucket, however, in this attitude, the bar 11 is held by the lip 43 so that the fork lift elements merely pivot about bar 11 without being freed entirely from the bucket. The back surface 45 of notch 21 extends generally parallel to the front face of the bucket 19 so that in the event that the fork lift elements slide, as described in reference to FIG. 3, the rod 11 similarly slides along surface 45 of the retaining hooks. Surfaces 45 and 25 of course extend obliquely to one another.

It will be noted that the load bearing surfaces are formed as the lower surface of relatively short horizontally extending portions of the fork lift elements 47 near the upper extremities of the vertical portions 39 and that the load bearing surfaces are preferably contoured to meet with the cross-section configuration of the support means 23. As illustrated, this support means may be simply a piece of angle iron welded to the top of the bucket. The retaining hooks may be formed integral with this support means and the combination later attached to a bucket or the retainer hooks may be individually fastened to a bucket and support means of triangular, square, half-round or other suitable configuration attached to the bucket upper surface intermediate the retaining hooks. The cross-sectional configuration of the support means 23 should be of such a nature that the corresponding contour 27 easily mates therewith when there is relative rotation between the fork lift elements 35 and 37 and the bucket 19 about the axis of horizontal bar 11. Numerous cross-sectional configurations which will provide adequate support for the fork lift elements without interfering with this pivotal motion during engagement of the attachment and bucket are possible.

From the foregoing it is now apparent that a novel attachment for a movable bucket with an independent load bearing arrangement has been described meeting the objects and advantageous features set out hereinbefore as well as others and that modifications as to the precise configurations, shapes and details may be made by those having ordinary skill in the art without departing from the spirit of the invention or the scope thereof as set out by the claims which follow.

What is claimed is:

1. An attachment for use with a movable bucket or the like having a plurality of substantially similar spaced retaining hooks, each of said hooks including a notch having an opening intermediate the ends thereof, and each of said hooks being fastenable to an upper portion of a movable bucket along a substantially horizontal line with the hook notch openings aligned; and support means fastenable to the upper portion of the movable bucket intermediate the retaining hooks, the attachment comprising:

(1) an elongated horizontal bar having a length greater than the distance between the outer ones of said spaced retaining hooks, said horizontal bar adapted to be easily picked up by said retaining hooks with the ends of said horizontal bar positioned outwardly of said outer spaced retaining hooks respectively;

(b) first and second fork lift elements mounted on said horizontal bar, each of said fork lift elements having a rigid, generally L-shaped configuration formed by a vertical portion and a horizontal portion, the upper end of said vertical portion being mounted on said horizontal bar and including a load bearing surface adjacent the horizontal bar for engaging the support means with the lower part of said vertical portion adapted to rest against the forward face of said bucket with the horizontal portion extending forwardly from said bucket with the end of said horizontal portion spaced from said bucket so that the weight of the fork lift elements and any load carried by those fork lift elements is carried primarily by the support means; and the support means comprising, an elongated bar fastenable by welding to the outer surface of the upper portion of the movable bucket near the front edge thereof.

2. The attachment of claim 1 wherein at least a pair of hooks are provided with safety catches normally overlying the horizontal bar for retaining that bar within the hook notches in the event that the bucket is moved to a position where the fork lift elements slide along the forward face of the bucket.

3. The attachment of claim 2 wherein at least the pair of hook notches include guide surfaces for engaging the horizontal bar and aligning the load bearing surface of each fork lift element with the support means.

4. The attachment of claim 1 wherein each of the plurality of hook notches includes a guide surface for engaging for the Horizontal bar and aligning the load bearing surface of each fork lift element with the suppport means.

5. The attachment of claim 1 wherein the support means comprises an elongated bar fastenable by welding to the upper portion of the movable bucket near the front edge thereof, the load bearing surfaces being contoured to mate with the cross section configuration of the support means.

6. The attachment of claim 5 wherein at least some of the retaining hooks include guide surfaces extending from the notch opening and along the notch for engaging the horizontal bar and aligning the load bearing surface countours with the support means.

7. The attachment of claim 1 wherein the support means comprises an elongated member extending across the top edge of the bucket on which the fork lift elements rest during use with the retaining hooks functioning only during initial engagement of the attachment by the bucket to align the load bearing surfaces with the elongated member and as a safety catch.

8. The attachment of claim 1 wherein the load bearing surfaces comprise relatively short horizontally extending portions of the fork lift elements near the upper extremities of the vertical portions.

9. An attachment for use with a movable bucket or the like having a plurality of substantially similar spaced retaining hooks, each of said hooks including a notch having an opening intermediate the ends thereof, and each of said hooks being fastenable to an upper portion of a movable bucket along a substantially horizontal line with the hook notch openings aligned; and support means fastenable to the upper portion of the movable bucket intermediate the retaining hooks, the attachment comprising:

(a) an elongated horizontal bar having a length greater than the distance between the outer ones of said spaced retaining hooks, said horizontal bar adapted to be easily picked up by said retaining hooks with the ends of said horizontal bar positioned outwardly of said outer spaced retaining hooks respectively;

(b) first and second fork lift elements mounted on said horizontal bar, each of said fork lift elements having a rigid, generally L-shaped configuration formed by a vertical portion and a horizontal portion, the upper end of said vertical portion being mounted on said horizontal bar and including a load bearing surface adjacent the horizontal bar for engaging the support means with the lower part of said vertical portion adapted to rest against the forward face of said bucket with the horizontal portion extending forwardly from said bucket with the end of said horizontal portion spaced from said bucket so that the weight of the fork lift elements and any load carried by those for lift elements is carried primarily by the support means; and at least a pair of said hooks being provided with safety catches normally over lying the horizontal bar for retaining that bar within the hook notches in the event that the bucket is moved to a position where in fork lift elements slide along the forward face of the bucket, the hook notches of said pair including guide surfaces for engaging the horizontal bar and aligning the load bearing surface of each fork lift element with the support means and a pair of surfaces extending obliquely to the guide surfaces and generally parallel to the forward face of the bucket between the guide surfaces and the safety catches.

* * * * *